US009080332B1

(12) United States Patent
Bord et al.

(10) Patent No.: US 9,080,332 B1
(45) Date of Patent: Jul. 14, 2015

(54) CONCRETE LOG SIDING

(71) Applicant: BORD TECH, LLP, Wisconsin Rapids, WI (US)

(72) Inventors: James P. Bord, Wisconsin Rapids, WI (US); William A. Bord, Wisconsin Rapids, WI (US)

(73) Assignee: BORD TECH, LLP, Wisconsin Rapids, WI (US)

( * ) Notice: Subject to any disclaimer, the term of this patent is extended or adjusted under 35 U.S.C. 154(b) by 0 days.

(21) Appl. No.: 14/186,946

(22) Filed: Feb. 21, 2014

(51) Int. Cl.

| | |
|---|---|
| ***E04B 1/10*** | (2006.01) |
| ***E04F 13/08*** | (2006.01) |
| ***B28B 1/14*** | (2006.01) |
| ***B28B 7/00*** | (2006.01) |

(52) U.S. Cl.
CPC ..... *E04F 13/0871* (2013.01); *B28B 1/14* (2013.01); *B28B 7/007* (2013.01); *E04F 13/0864* (2013.01)

(58) Field of Classification Search
CPC ..... E04C 3/127; E04F 13/0864; E04F 13/08; E04F 13/0871; E04F 13/072; E04B 2/702; E04B 2/705
USPC ..... 52/233, 313, 316, 543, 478
See application file for complete search history.

(56) References Cited

U.S. PATENT DOCUMENTS

| | | | | |
|---|---|---|---|---|
| 1,510,326 | A * | 9/1924 | Locke | 52/92.1 |
| 1,511,955 | A | 10/1924 | Fisher | |
| 1,841,127 | A | 1/1932 | Ilson | |
| 2,045,482 | A | 6/1936 | Maier | |
| 2,687,033 | A | 8/1954 | Snyder | |
| 3,561,181 | A | 2/1971 | Bassett | |
| 4,288,954 | A * | 9/1981 | O'Donnell | 52/233 |
| 4,320,610 | A | 3/1982 | Rupp | |
| 4,433,519 | A | 2/1984 | Jenkins | |
| 5,010,701 | A | 4/1991 | Halsey, Jr. et al. | |
| 5,167,103 | A | 12/1992 | Lindal et al. | |
| 5,181,358 | A | 1/1993 | Mead | |
| 5,253,458 | A | 10/1993 | Christian | |
| 5,271,878 | A | 12/1993 | Mizia et al. | |
| 5,423,153 | A | 6/1995 | Woolems et al. | |
| 5,638,649 | A | 6/1997 | Hovland | |
| 5,685,116 | A * | 11/1997 | Bradshaw et al. | 52/311.1 |
| 5,735,099 | A | 4/1998 | Anderson | |
| 6,408,580 | B1 | 6/2002 | Jurvis et al. | |
| 6,505,446 | B1 | 1/2003 | McCrary | |
| 6,647,687 | B2 | 11/2003 | Kern | |
| 6,786,015 | B2 | 9/2004 | Wilt | |
| 6,851,233 | B2 | 2/2005 | Morgenstern | |
| 6,910,305 | B1 | 6/2005 | Kassis | |
| 7,028,436 | B2 | 4/2006 | Bezubic, Jr. | |

(Continued)

FOREIGN PATENT DOCUMENTS

| | | |
|---|---|---|
| EP | 2309069 A3 | 11/2012 |
| JP | 01219218 | 9/1989 |

(Continued)

*Primary Examiner* — Brian Glessner
*Assistant Examiner* — Paola Agudelo
(74) *Attorney, Agent, or Firm* — Ryan Kromholz & Manion, S.C.

(57) ABSTRACT

Systems and methods directed to the art of simulated log siding are provided. Concrete log siding members may be installed as siding on a structure, and methods for making and installing such concrete log siding members on a structure are disclosed. The concrete log siding members have attachment means embedded in the concrete and protruding outward therefrom.

6 Claims, 13 Drawing Sheets

(56) References Cited

U.S. PATENT DOCUMENTS

| | | | | |
|---|---|---|---|---|
| 7,412,803 | B2 | 8/2008 | Lehn | |
| 7,647,738 | B2 | 1/2010 | Nasvik | |
| 7,856,790 | B2 * | 12/2010 | Jambois et al. | 52/748.1 |
| 8,302,355 | B2 | 11/2012 | Cook et al. | |
| 8,341,898 | B1 | 1/2013 | Mizia et al. | |
| 8,387,338 | B1 | 3/2013 | Smith | |
| 2001/0047741 | A1 * | 12/2001 | Gleeson et al. | 106/709 |
| 2002/0046524 | A1 | 4/2002 | Li et al. | |
| 2004/0187411 | A1 | 9/2004 | Clegg | |
| 2004/0211136 | A1 | 10/2004 | Stanton | |
| 2005/0115177 | A1 | 6/2005 | Morgenstern | |
| 2008/0282629 | A1 * | 11/2008 | Cook et al. | 52/233 |
| 2011/0078966 | A1 * | 4/2011 | Herman | 52/233 |
| 2013/0008107 | A1 * | 1/2013 | Herman | 52/233 |
| 2013/0055668 | A1 | 3/2013 | Cook et al. | |
| 2013/0199119 | A1 * | 8/2013 | Hansen et al. | 52/536 |

FOREIGN PATENT DOCUMENTS

| | | | |
|---|---|---|---|
| JP | 2002322659 | A | 11/2002 |
| JP | 3517510 | B2 | 4/2004 |

* cited by examiner

CONCRETE LOG SIDING

BACKGROUND OF THE INVENTION

Natural log built homes and buildings have been a thread in the American tapestry since the first settlers laid claim to the New World. The natural log structures are well known for their robust nature and also their aesthetic qualities. However, structures comprised of real wood logs are not only expensive, but they are susceptible to damage from environmental elements such as water, temperature changes, insect infestation, and fire.

In an attempt to avoid some susceptibilities of natural log structures, simulated log siding constructed of cement or other water impermeable coatings has been developed. However, these prior simulated log siding systems suffer from some disadvantages, such as clumsy installation and excess material usage. Accordingly, the art of simulated log siding could benefit from a more efficiently assembled, durable, and more authentic looking, pre-manufactured concrete log.

SUMMARY OF THE INVENTION

The present invention relates to a more efficiently assembled, and a more authentic looking pre-manufactured concrete log. The present invention comprises concrete, a nailing anchor, and a plurality of pinning anchors. Whereby, the pinning anchors of a first log interface with the nailing anchor of a log installed below.

A siding member according to the present invention may include a body having a body length extending between and including two ends. The body preferably has an arc profile defined perpendicular to the length. The body has an outer, wherein the arc profile has a thickness terminating at a first side surface and a second side surface. The siding member further includes a nailing anchor structure extending outward from the body against the first side surface perpendicular to and along the body length. A pinning anchor structure, which may include a plurality of pins extending perpendicular to the body length, extends outward from the body against the second side surface.

According to an aspect of a siding member according to the present invention, the body of the member may be formed from a concrete mixture, such as a glass fiber reinforced concrete that preferably includes cement and glass fibers.

A concrete mixture that may be used to make siding members according to the present invention includes, in percent by weight, 1-2% of a first glass fiber having a nominal length of 19 millimeters, 0.5-2% of a second glass fiber having a nominal length of 38 millimeters, 40-50% Portland cement, 35-40% #30 sand, 5-12% water, 2-5% liquid polymer, up to two percent coloring, and up to 0.5 fluid ounces of a plasticizer.

According to another aspect of a siding member according to the present invention, such siding member may have an arc profile of a circular arc extending about 120 degrees.

According to yet another aspect of a siding member according to the present invention, the nailing anchor structure may include a plurality of rungs spanning two rails, wherein a first of the two rails is embedded within the body, the plurality of rungs extends through the first side surface, and the second of the two rails extends for a majority of the body length outside of the body. The nailing anchor structure and/or pinning anchor structure may be formed from a ladder mesh reinforcement of 9 gauge galvanized steel. When used to construct the pinning anchor structure, one of the rails may be removed from the ladder mesh.

A still other aspect of a siding member according to the present invention provides the outer surface of the body with a wood grain pattern.

A simulated log siding system according to the present invention may include at least one lateral body member, at least one corner member and at least one casing member. The body member may be of the embodiment described above. The corner member preferably includes a corner body comprising a corner body length, a corner body arc profile perpendicular to the corner body length, and a corner body outer surface, the corner body arc profile having a thickness defining a corner body first side surface and a corner body second side surface extending along the corner body length. The corner body outer surface may comprise a wood grain pattern. The corner body may further include a pair of corner member end-caps, one at each end of the corner body length and shaped to receive a corner of a building structure. A plurality of straps preferably extend outward from the corner body first side surface and/or the corner body second side surface, each of the plurality of straps having a plurality of holes to accept fasteners for mounting the corner member to a building structure. The casing member may include a casing body length, a substantially square U-shape profile perpendicular to the casing body length, a casing body exterior surface, and a thickness defining a casing body first side surface and a casing body second side surface at the top of the U-shape and extending along the casing body length. The casing body exterior surface may be provided with a wood grain pattern. A plurality of straps preferably extends outward from the casing body first side surface and/or the casing body second side surface, each of the plurality of straps having a plurality of holes to accept fasteners for mounting the corner member to a building structure. The system further preferably includes a plurality of fasteners for attaching the at least one lateral member, the at least one corner member, and the at least one casing member to the exterior of a structure.

According to an aspect of an embodiment of a simulated log siding system according to the present invention, the corner member arc profile emulates a half circle.

According to another aspect of an embodiment of a simulated log siding system according to the present invention, one or more casing body may also include a pair of casing member end caps, one on each end of the casing body length. The casing body may include a sloped (such as outward by about 15 degrees) stem of the U-shaped profile.

An embodiment of a method for forming a simulated log siding member according to the present invention may include the steps of: providing a pipe having a length and cutting the pipe along the length to expose an internal surface of the pipe. A wood grain pattern may be formed into the internal surface of the pipe. A release agent may be applied to the internal surface, and a first layer of concrete mixture may be brushed, sprayed, or otherwise applied to the internal surface. The first layer of concrete mixture preferably has no glass fiber in it. One or more layers of concrete mixture, such as a glass fiber reinforced concrete (GFRC) mixture is applied over the first layer. An attachment means may be embedded at least partially in the GFRC mixture. The concrete is allowed to cure and it is then removed from the pipe. A sealer and stain may be applied to at least the outer surface of the cured concrete.

According to an aspect of a method according to the present invention, the method may further include the step of removing bubbles from at least one of the first layer of concrete mixture and a GFRC mixture layer.

A method for installing a simulated log siding system a building structure may include the steps of providing one or more lateral body members, one or more corner members, and one or more casing members, as described herein. The method further includes installing the at least one corner member to a corner of the structure by mating the pair of corner member end-caps with two adjacent exterior walls of the structure and securing the at least one corner member by installing fasteners through at least one of the plurality of holes of each of the plurality of straps and into the respective exterior wall. An installation method may further comprise the step of installing the at least one casing member to at least one side of a window frame and door frame and securing the at least one casing member by installing the fasteners through at least one of the plurality of holes of each of the plurality of straps and into the side of the window frame or door frame. Preferably after the corner member and casing member are installed, the lateral body members may be installed, such as in courses, by placing the at least one member against the exterior wall with the nailing anchor oriented upward and installing one of the fasteners about the rail of the nailing anchor and into the exterior wall. Consecutive courses of lateral members may be installed by placing the at least one pinning anchor of the consecutive, upper course lateral member behind the first course lateral member and behind the lower course lateral member nailing anchor, and installing one of the fasteners about the rail of the nailing anchor of the second course lateral member and into the exterior of the wall.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
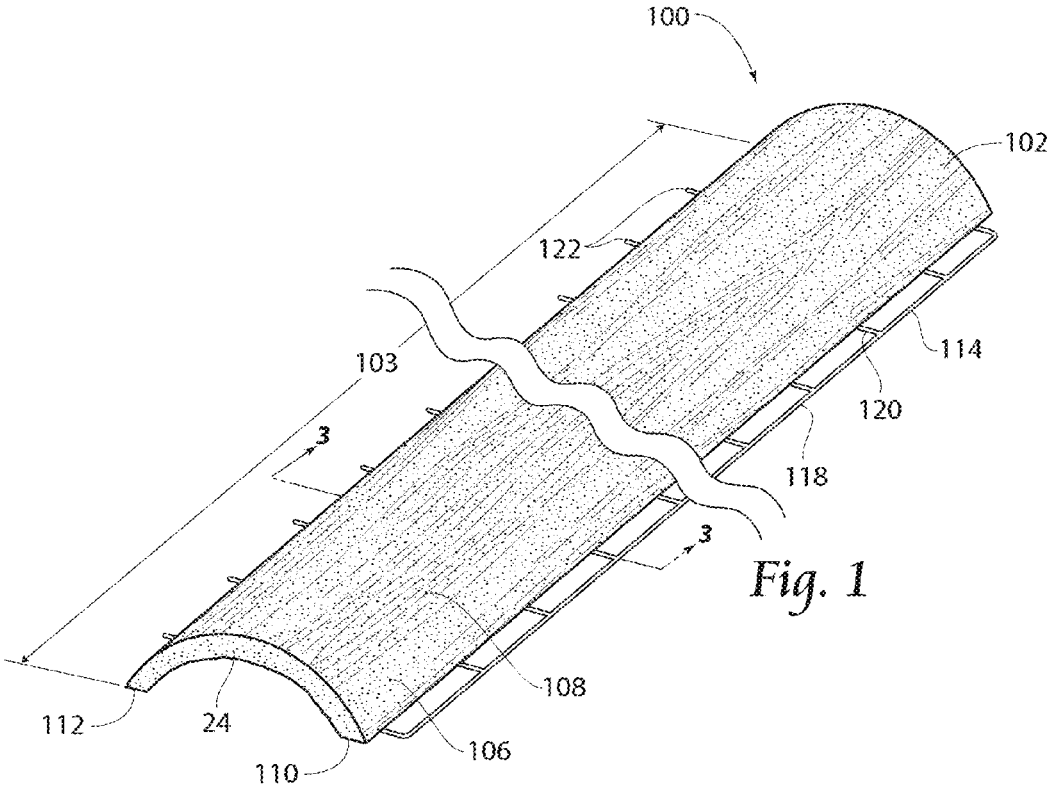
FIG. 1 is a perspective view of a first embodiment of a concrete log member according to the present invention.

A first embodiment 100 of a concrete log siding member is shown in FIG. 1. The lateral member 100 comprises a lateral body 102, a nailing anchor 114, and a plurality of pinning anchors 122.

Figure 2:
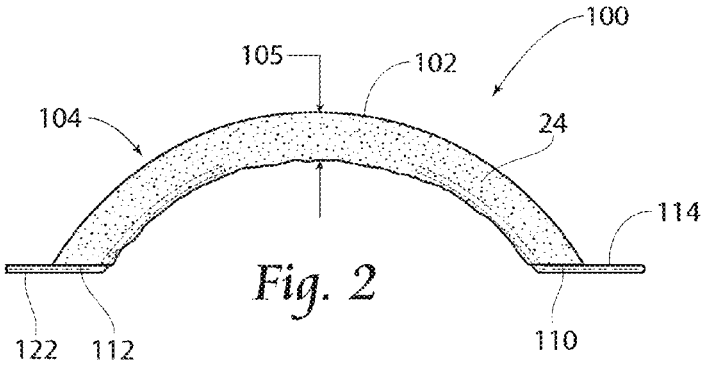
FIG. 2 is a side view of the concrete log member of FIG. 1.

Continuing to look at FIG. 1 and additionally FIG. 2, the lateral body 102 preferably has a lateral body length 103; a lateral body arc profile 104, with thickness 105, perpendicular to the lateral body length 103; and a lateral body outer surface 106 with a wood grain pattern 108. The lateral body arc thickness 105 is preferably substantially constant throughout the lateral member body and further defines a lateral body first side surface 110 and a lateral body second side surface 112 which extend along the lateral body length 103 (see FIG. 12).

A preferred lateral body length 103 is about 8 feet and the preferred corner body thickness 105 is preferably an average of about ⅜ inch; however other lengths and thicknesses are contemplated.

The lateral body arc profile 104 is preferably a substantially circular arc that extends through approximately 120 degrees. The radius of the profile is preferably about 4 inches to about 8 inches, with about 6 inches being preferred. It should be noted, however, that the radius of the lateral body arc profile 104 may be larger or smaller and still be within the purview of the present invention.

Figure 3:
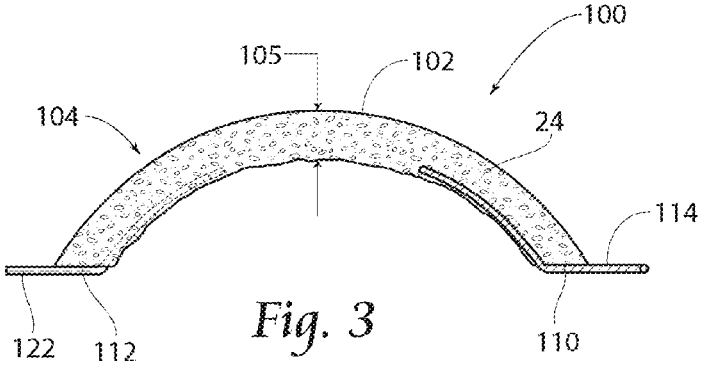
FIG. 3 is a cross-sectional view of the concrete log member along line 3-3 of FIG. 1.

With additional attention directed to FIG. 3, the nailing anchor 114 extends outward from the lateral body 102, against the lateral body first side surface 110 and perpendicular to the lateral body length 105. The nailing anchor 114 preferably comprises a Hohmann & Barnard, Inc. 220 Ladder Mesh Reinforcement. A preferred nailing anchor 114 has a pair of rails (one covered rail 116 (see FIG. 10) and one exposed rail 118; more detail provided below) spaced apart approximately 6 inches and connected by rungs 120 spaced at approximately 16-inch intervals. The rails 116,118 and rungs 120 are preferably made from 9 gauge galvanized steel.

The nailing anchor 114 is preferably formed to conform to the shape of the lateral body 102 by bending the rungs 120 approximately 15 degrees approximately at their centers between the rails 116,118 or, at the very least, bent at an angle to be enveloped by the GFRC mixture 24 during production (described in more detail below). It should be understood, however, that any structure having a set of rails 116,118 extending substantially the length 103 with evenly or unevenly spaced rungs 120 and an exposed rail 118 may be used.

A plurality of pinning anchors 122 preferably extends outward from the lateral body 102, against the lateral body second side surface 112 and perpendicular to, and spaced along, the lateral body length 105. The plurality of pinning anchors 122 preferably is formed from a Hohmann & Barnard, Inc. 220 Ladder Mesh Reinforcement. The preferred 220 Ladder Mesh Reinforcement is similar to the nailing anchor 114 discussed above; however, unlike the nailing anchor 114, what would be the exposed rail 118 of the 220 Ladder Mesh Reinforcement is removed to expose the plurality of rungs or pinning anchors 122. Preferably, the pinning anchors 122 remain attached to the covered rail 116 to maintain proper spacing and orientation of the pinning anchors 122.

The plurality of pinning anchors 122 and the covered rail 116 are preferably made from 9 gauge galvanized steel. Furthermore, the 220 Ladder Mesh Reinforcement is preferably formed to conform to the shape of the lateral body 102 by bending the rungs 120 approximately 15 degrees at their centers, or, at the very least, bent at an angle such that the covered rail 116 and at least a portion of the rungs 120 may be enveloped by the GFRC mixture 24 during production (described in more detail below). It should be understood, however, that any structure having a plurality of pinning anchors 122 extending outward from the lateral body 102 in the manner described herein may be used. The placement of the pinning anchors 122 along the lateral body second side surface 112 is preferably offset from the placement of the rungs 120 of the nailing anchor 114 on the first side surface along the length 105.

Figure 4:
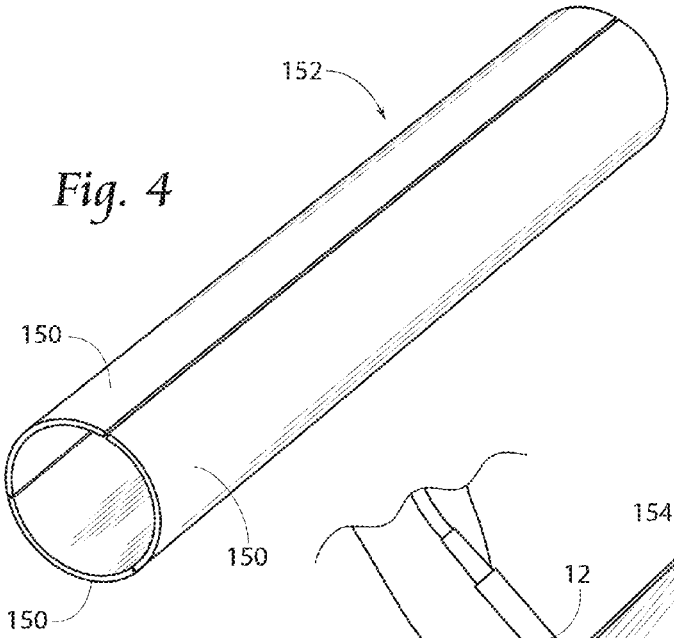
FIG. 4 is a perspective view of a pipe divided to provide forms according to the present invention.
Figure 5A:
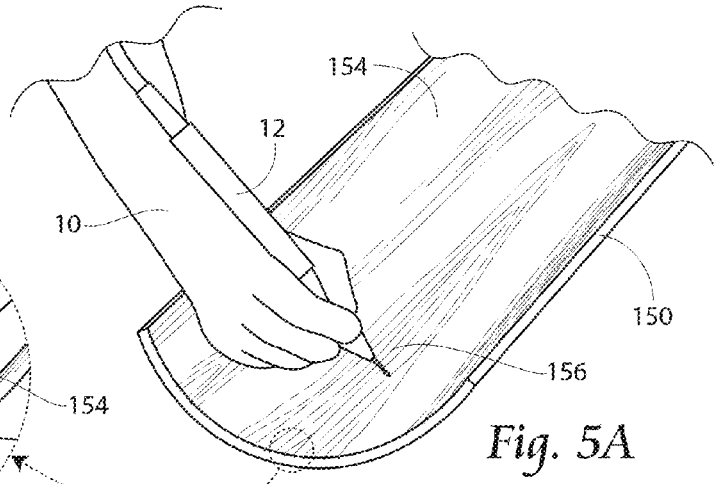
FIG. 5A is a perspective view of a predetermined pattern being formed on one of the pieces of pipe of FIG. 4 to create a form according to the present invention.
Figure 5B:
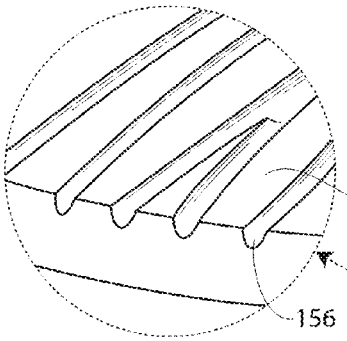
FIG. 5B is a close-up view of the imparted wood grain of FIG. 5A.

FIGS. 4-5B illustrate the method of making and preparing a lateral member form 150 to mold the lateral member 100 according to the present invention. FIG. 4 shows a piece of tubular 12 inch PVC schedule 40 pipe 152, or similar type polymer pipe, trisected along its length to provide three lateral member forms 150, each extending about approximately 120° of the circumference of the pipe 152. It is contemplated that other pipe sizes may be used to form lateral members 150 of various heights and/or widths.

FIG. 5A shows an operator 10 engraving a wood-grain pattern 156 into the lateral member form interior surface 154 with an engraving tool 12 (e.g, a DREMEL® tool). This operation may also be performed by a CNC machine (not shown) or other method known in the art. FIG. 5B provides a closer look as to a portion of the engraved wood grain pattern 156.

Figure 6:
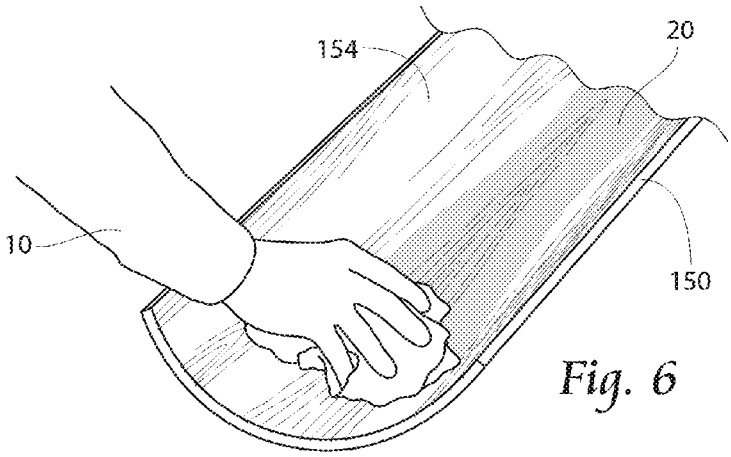
FIG. 6 is a perspective view of a release agent being applied to the form of FIG. 5A.

Continuing now to FIGS. 6-14, the production and finishing of the lateral member 100 according to the present invention may be described. FIG. 6 shows a light coat of 880-VOC release agent 20 being applied to the lateral member form interior surface 154. The release agent 20 promotes ease of separation of the lateral member 100 from the lateral member form 150 after molding.

Figure 7:
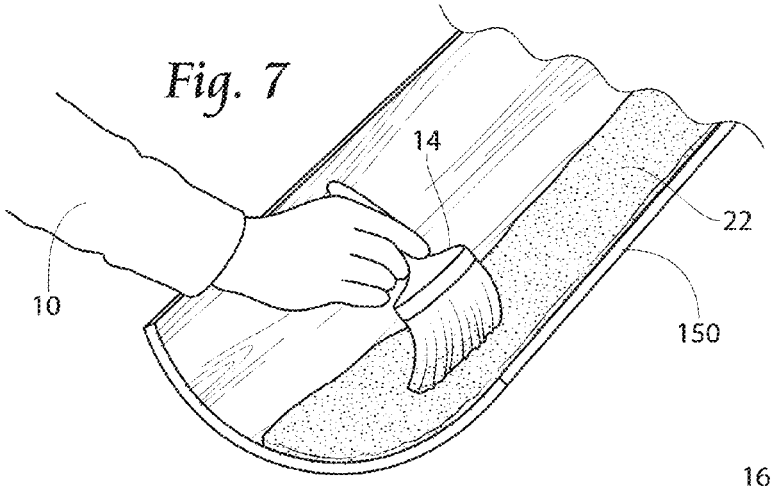
FIG. 7 is a perspective view of an operator applying a first layer of concrete mixture to the form of FIG. 5A according to the present invention.

In FIG. 7 a light first coat of colored concrete mixture 22 is sprayed into the lateral member form 150. The concrete mixture in the first coat 22 preferably does not contain glass fiber. Further, as depicted here, the concrete mixture 22 may be brushed into the lateral member form 150 with a paint brush 14 to remove any air bubbles that may be present in the mixture 22 and to ensure the mixture 22 thoroughly coats the lateral member form 150 and into the wood-grain pattern 156.

Figure 8:
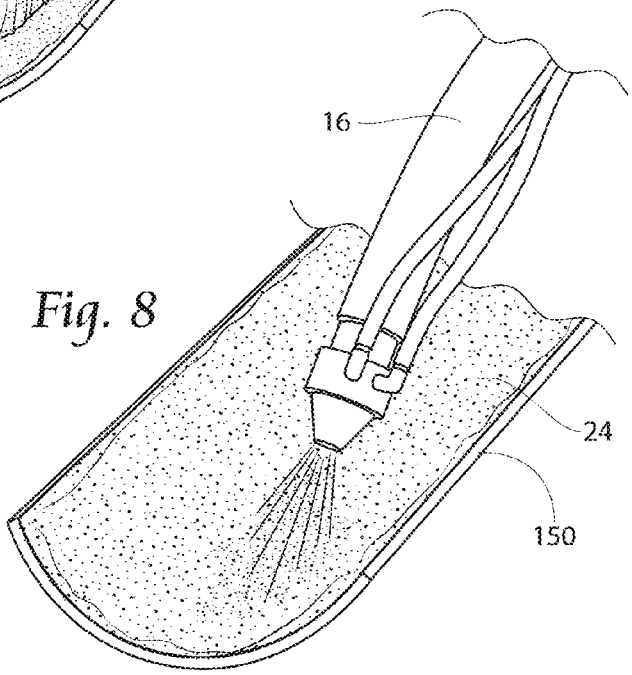
FIG. 8 is a perspective view of additional layers of a glass fiber reinforced concrete mixture being applied to the form of FIG. 5A according to the present invention.
Figure 9:
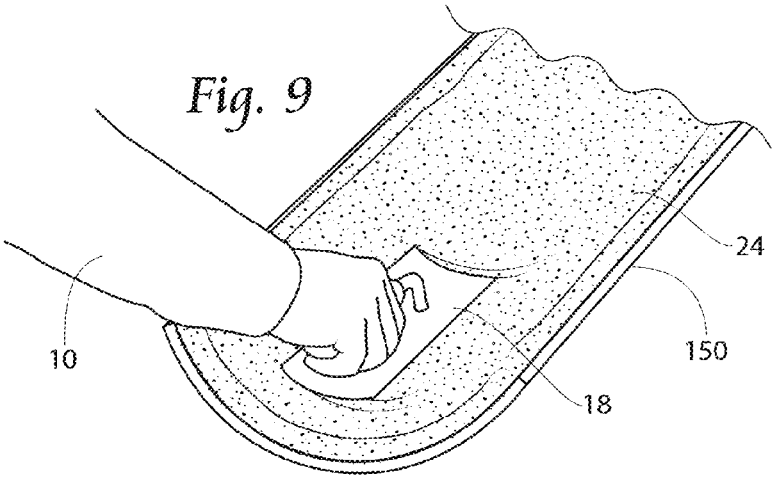
FIG. 9 is a perspective view of a trowelling step according to the present invention.

FIGS. 8 and 9 illustrate the application of a GFRC mixture 24 through a sprayer 16 into the lateral member form 150. Preferably, the GFRC mixture 24 is applied in consecutive layers until an overall thickness of approximately ⅜ inch is achieved. After each layer is applied, a trowel 18 may be used to remove any air bubbles in the GFRC mixture 24.

Figure 10:
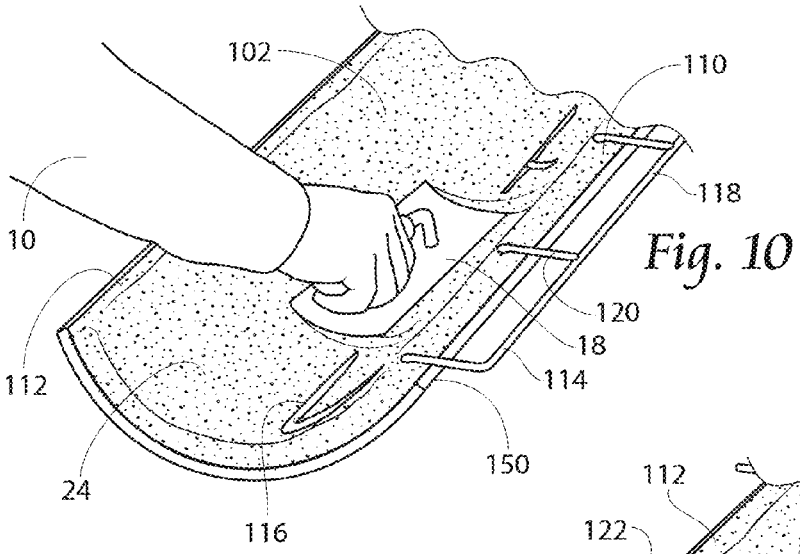
FIG. 10 is a perspective view of an operator installing a hanging means in the concrete of FIG. 9 according to the present invention.

FIG. 10 illustrates the installation of the nailing anchor 114. As previously indicated, the nailing anchor 114 may be bent to approximate the interface of the arc profile 106 and the lateral body first side surface 110. After the nailing anchor 114 is bent to fit the shape of the lateral member 100, it is placed within the GFRC mixture 24 and positioned with the rungs 120 across the lateral body first side surface 110, and the trowel 18 is used to ensure complete coverage/submersion of the nailing anchor 114 into the GFRC mixture 24. Alternatively, the anchor 114 may be affixed to the lateral member 100 prior to the anchor 114 being bent.

Figure 11:
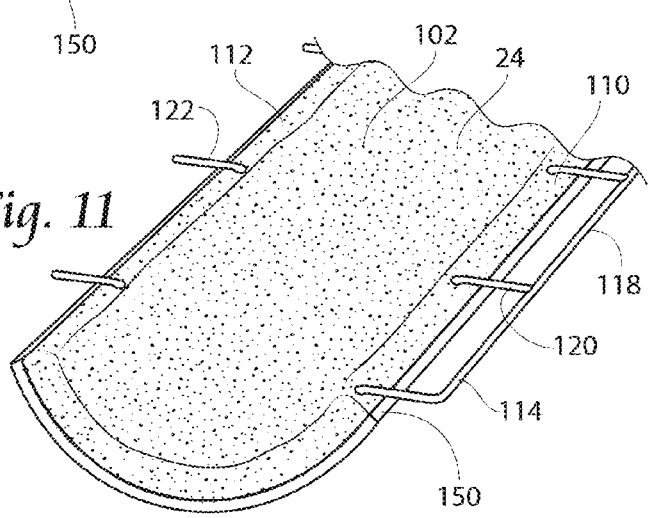
FIG. 11 is a perspective view of the concrete of FIG. 10 curing according to the present invention.

The pinning anchors 122 are installed preferably in the same manner as, and after or before, the nailing anchor 114. That is, placing the pre-bent pinning anchors 122 into the GFRC mixture 24 and positioned with the pinning anchors across the lateral body second side surface 112, and using the trowel 18 to ensure complete coverage/submersion. FIG. 11 depicts the plurality of pinning anchors 122 as exposed prior to the lateral member 100 being removed from the lateral member form 150; however, the exposed rail (as shown as part number 118 on the nailing anchor 114) of the 220 Ladder Mesh Reinforcement may be removed to expose the pinning anchors 122 prior to installation, during the curing period, or after removal of the lateral member 100 from the lateral member form 150 (shown in FIG. 12).

Figure 12:
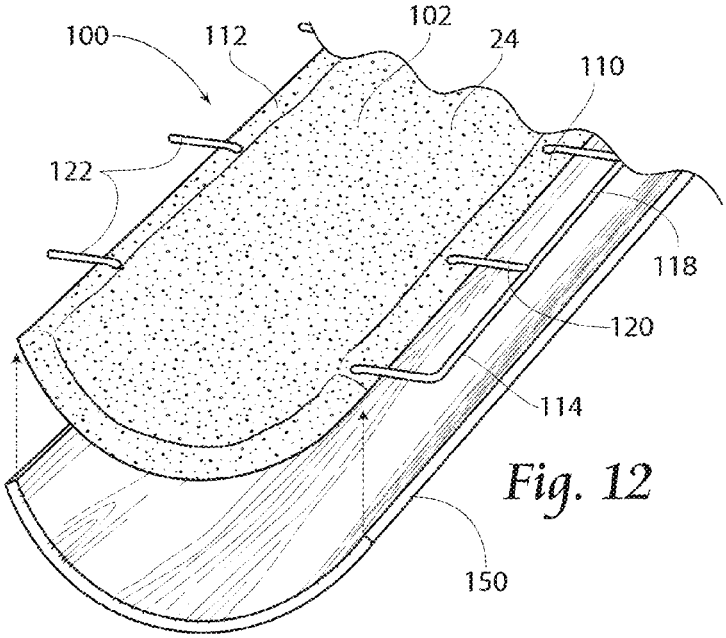
FIG. 12 is a perspective view of the concrete log member as it is removed from the form according to the present invention.
Figure 13:
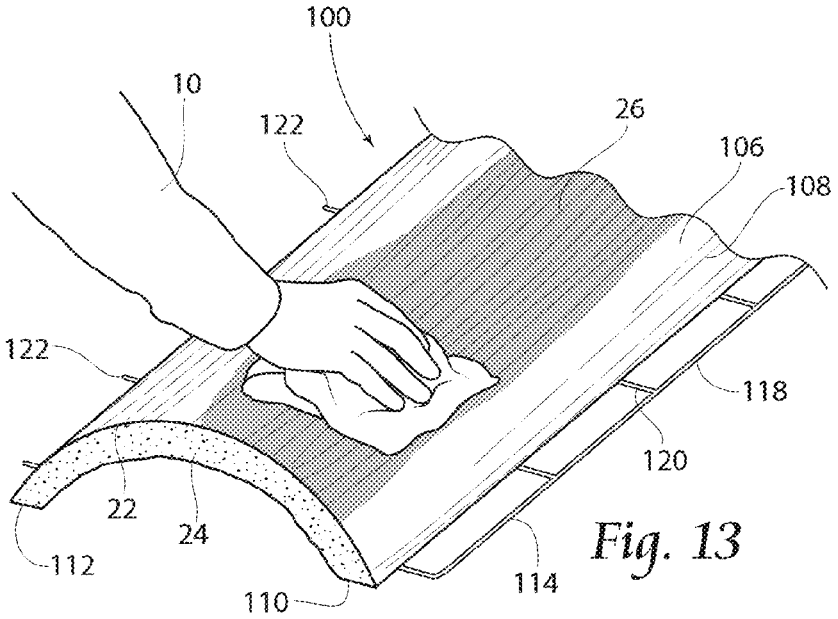
FIG. 13 is a perspective view of an operator applying a sealer to the concrete log member according to the present invention.

The lateral member 100 is allowed to cure overnight, or an otherwise adequate curing time, after which, the lateral member 100 is removed from the lateral member form 150 as shown in FIG. 12. After removal of the lateral member 100 from the lateral member form 150, a sealer 26 is rubbed onto the lateral member 100 (FIG. 13), at least on the outer surface 106, but other surfaces may be sealed as well. The sealer 26 is preferably a water-based acrylic sealer.

Figure 14:
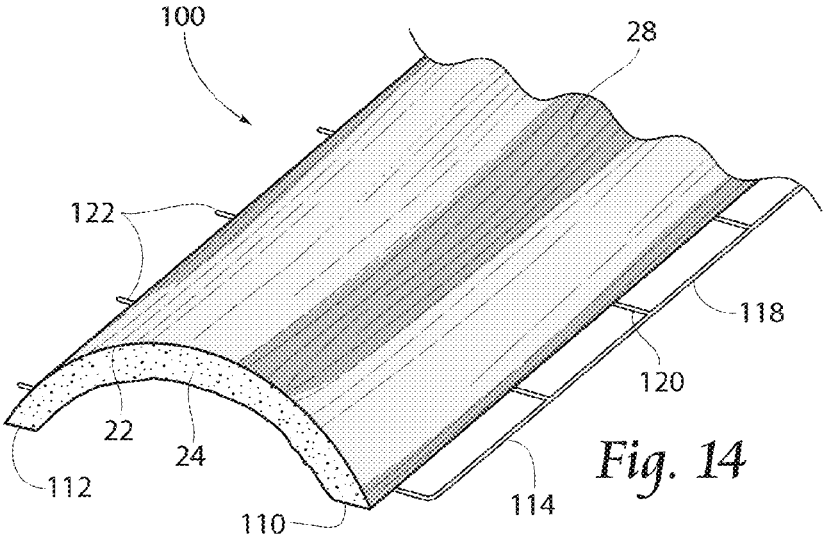
FIG. 14 is a perspective view of the concrete log member having been stained according to the present invention.

After the sealer 26 is dry, a stain 28 is rubbed onto the lateral member 100 and into the wood grain pattern 108 until the desired color is achieved, yet preferably still allowing the colored first coat 22 to show through (FIG. 14). The stain 28 is preferably a siliconized 100% acrylic and solid color concrete stain.

Figure 15:
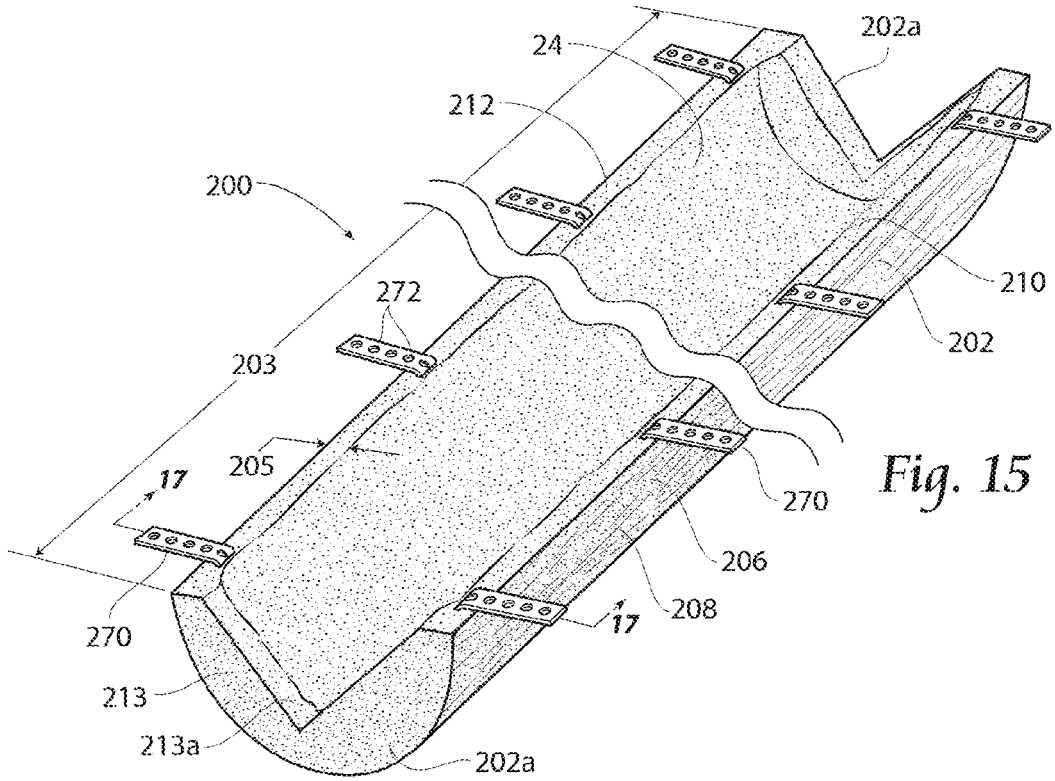
FIG. 15 is a perspective view of a second embodiment of a concrete log member according to the present invention.
Figure 16:
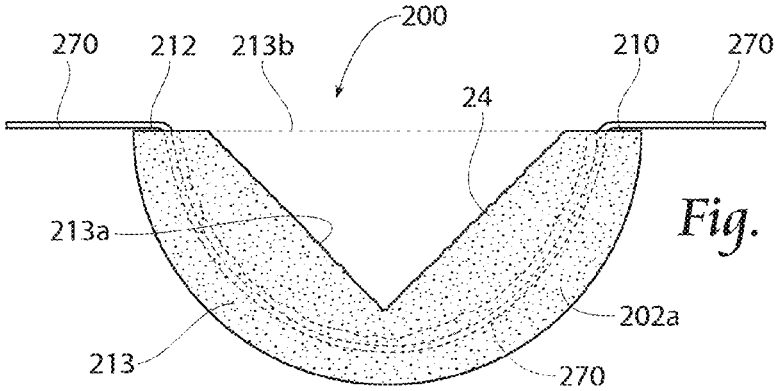
FIG. 16 is a left end view of the embodiment of FIG. 15.
Figure 17:
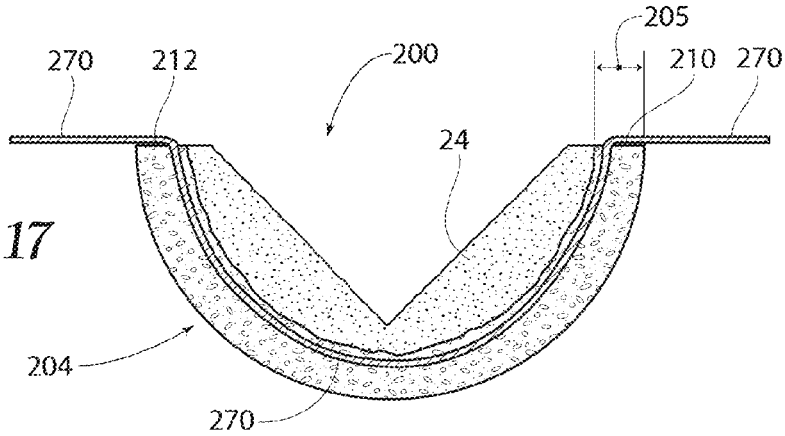
FIG. 17 is a cross-sectional view taken along line 17-17 of FIG. 15.

A second embodiment 200 of a concrete log siding member according to the present invention is shown as a corner member in FIGS. 15-17, where similar reference numerals are used to identify similar or identical structure or features to the first embodiment 100. The corner member 200 comprises a corner body 202 preferably having a corner body length 203 extending between and including two ends 202*a*; a corner body arc profile 204, with a thickness 205, perpendicular to the corner body length 203; and a corner body outer surface 206 with a wood grain pattern 208. The corner body thickness 205 is preferably substantially constant throughout the corner body 202 and further defines a corner body first side surface 210 and a corner body second side surface 212 which extend along the corner body length 203. A preferred corner body length 203 is about 10 feet and the preferred corner body thickness 205 is preferably an average of about ⅜ inch; however, other lengths and thicknesses are contemplated.

The corner body arc profile 204 is preferably a substantially circular arc that extends through approximately 180 degrees. The radius of the profile is preferably about 4 inches to about 8 inches, with about 6 inches being preferred. It should be noted, however, that the radius of the corner body arc profile 204 may be larger or smaller and still be within the purview of the present invention.

Preferably for installation alignment purposes, the corner member 200 comprises a pair of corner member end caps 213, one at each end 202*a* of the corner body 202. The corner member end caps 213 are preferably shaped to receive the corner of two adjacent walls 32 (see FIG. 22) and preferably have approximately the same thickness 205 as the rest of the corner body 202. More specifically, the corner member end caps 213 comprise a semi-circular piece with a notch 213*a*. The notch 213*a* is approximately shaped like a right triangle whereby the hypotenuse 213*b* of the right triangle is aligned with the corner body first side surface 210 and the corner body second side surface 212.

Additionally or alternatively, and also for secure installation, the corner member 200 may include one or more attachment straps 270 extending outward from the corner body first side surface 210 and the corner body second side surface 212. Each attachment strap 270 preferably has a plurality of holes 272 along its length. Each strap 270 may extend through the arc profile 204, being immersed and held within the thickness 205, protruding from both the first side surface 210 and the second side surface 212. Additionally or alternatively, each strap 270 may extend from only one of the first side surface 210 and the second side surface 212.

Figure 18:
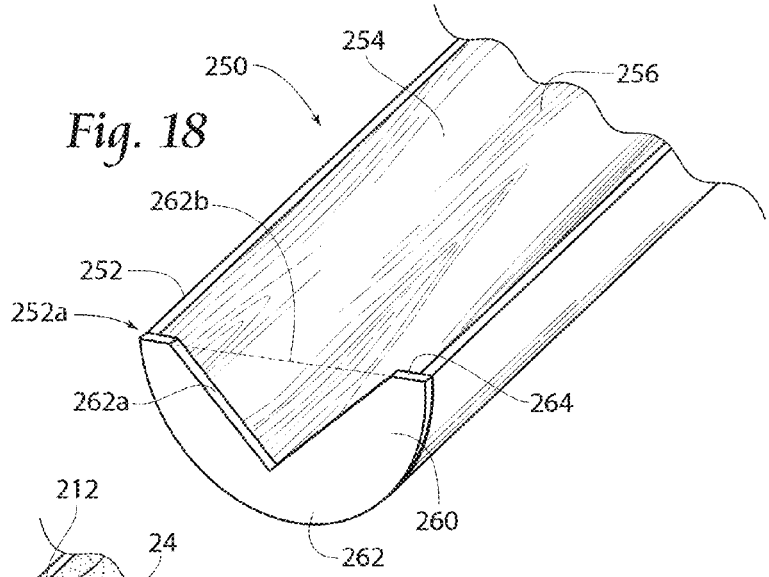
FIG. 18 is a perspective view of a second embodiment of a form according to the present invention.
Figure 19:
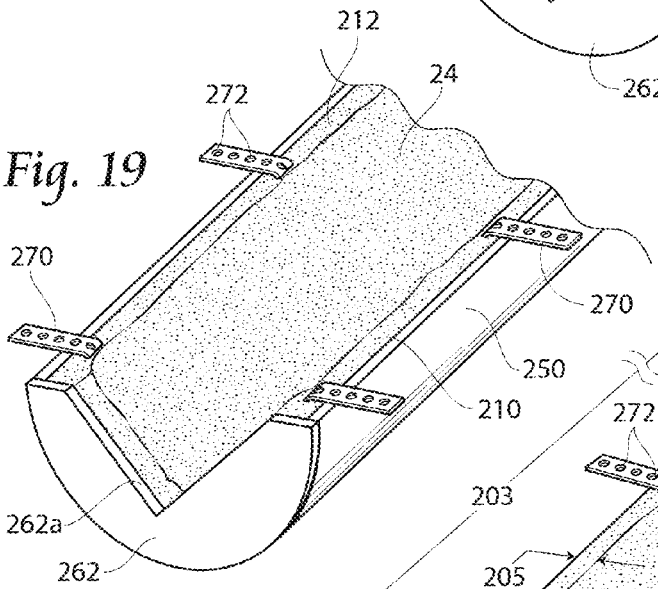
FIG. 19 is a perspective view of the embodiment of FIG. 15 curing in the form of FIG. 18 according to the present invention.
Figure 20:
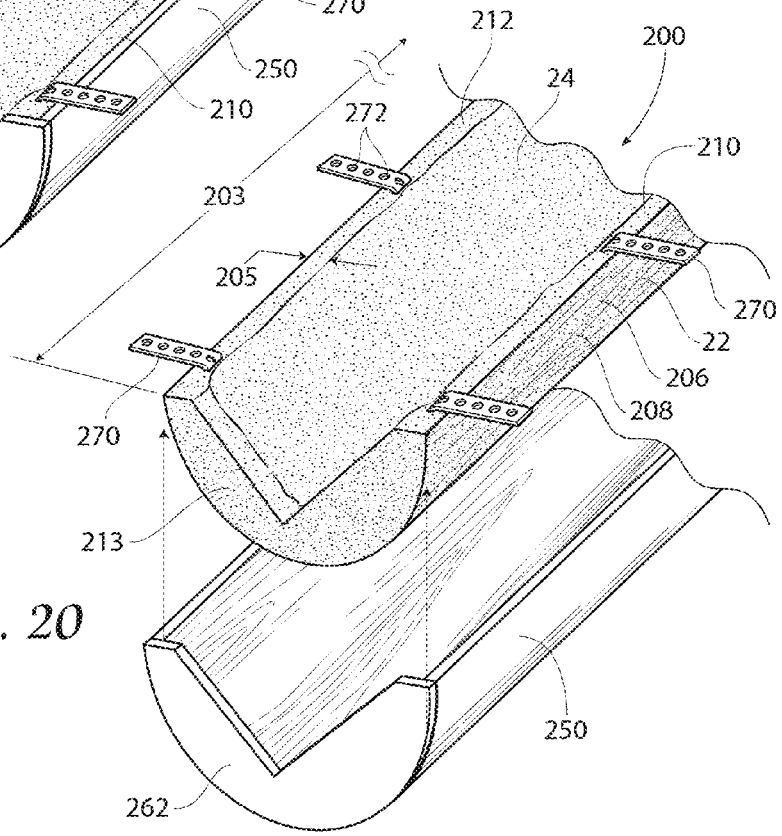
FIG. 20 is a perspective view of the embodiment of FIG. 15 being removed from the form of FIG. 18 according to the present invention.

As shown in FIGS. 18-20, the corner member 200 may be produced using a corner member form 250. The corner member form 250, as shown in FIG. 18, preferably comprises a cylindrical PVC schedule 40 pipe of a preferred diameter (e.g. 12 inches) which has been cut in half along its length to provide a half-pipe 252, extending between and including two ends 252*a*. It is contemplated that the half-pipe 252 be comprised of other polymeric pipes exhibiting similar characteristics to that of PVC and that the diameter may vary if various sized corner members 200 are desired.

A wood grain pattern 256 may be engraved on the corner member form interior surface 254 using an engraving tool 12. Additionally, a corner member form seal plate 260 is secured to each end 252*a* of the half-pipe 252. The corner member form seal plate 260 preferably comprises a semi-circular member 262 with a notch 262*a*. Preferably the notch 262*a* resembles a right triangle wherein the hypotenuse 262*b* of the right triangle is aligned with the flat side 264 of the corner member form seal plate 260. Further, the hypotenuse 262*b* of the notch 262*a* preferably does not extend the full diameter of the corner member form seal plate 260. In fact, the notch 262*a* preferably spans less than or equal to the diameter of the form 250 plus twice the planned thickness 205 of the layered GFRC mixture 24, (e.g., about 11.25 inches).

The production of the corner member 200 is substantially similar to that of the lateral member 100 discussed above. First, the release agent 20 (shown in FIG. 6) is applied to the corner member form inner surface 254. Then, a first layer of concrete mixture 22 without glass fibers (as shown in FIG. 7) is brushed into the corner member form 250. Next, consecutive layers of GFRC mixture 24 are sprayed into the corner member form 250, including onto the inside of the corner member form seal plates 260, and trowelled until the average or approximate predetermined thickness 205 is achieved. The plurality of attachment straps 270 may then be installed and trowelled into the corner body 202 so that they extend from the corner body first side surface 210 and/or the corner body second side surface 212. The corner body 202 may then be allowed to cure as shown in FIG. 19. Finally the corner member 200 is removed from the corner member form 250 as shown in FIG. 20.

Figure 21:
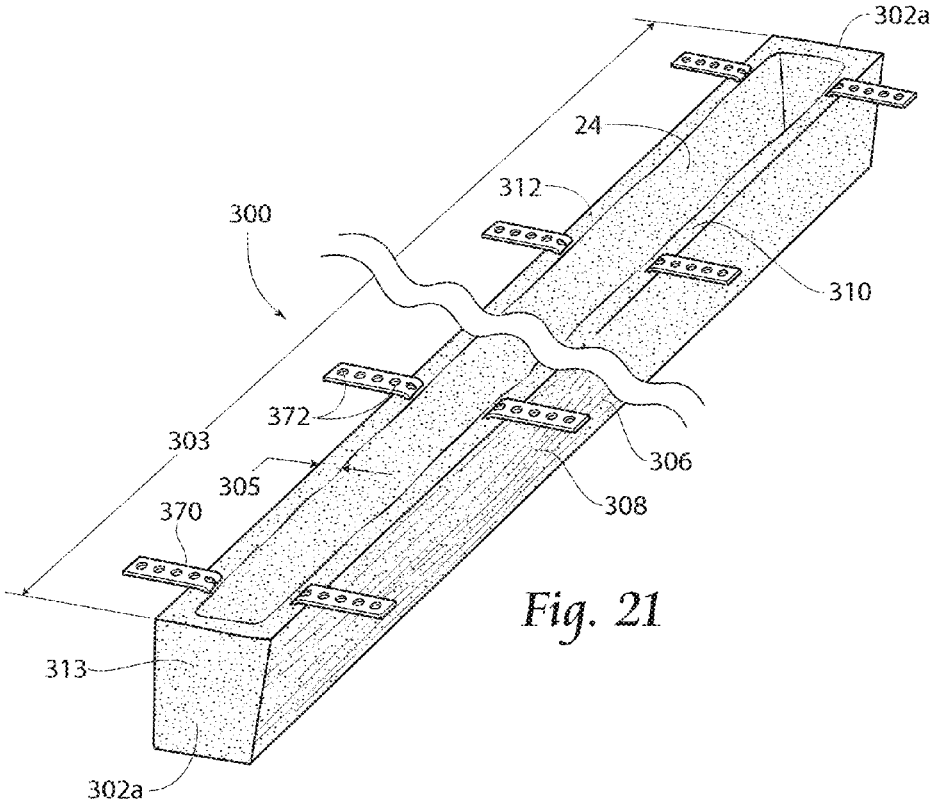
FIG. 21 is a perspective view of a third embodiment of a concrete log member according to the present invention.
Figure 22:
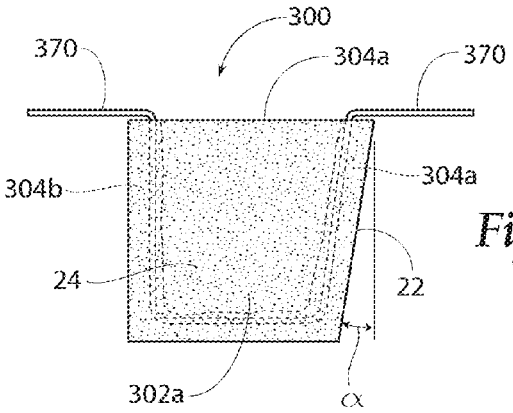
FIG. 22 is a left end view of the embodiment of FIG. 21.
Figure 23:
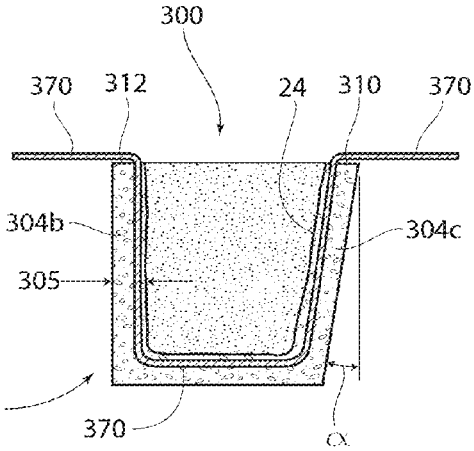
FIG. 23 is a cross-sectional view taken along line 23-23 of FIG. 21.

Looking now to FIGS. 21-23, a third embodiment 300 of a concrete log siding member according to the present invention is shown as a casing member. The casing member 300 preferably comprises a casing body 302 having a casing body length 303 extending between and including two ends 302*a*; a U-shape profile 304 perpendicular to the casing body length 303; a casing body exterior surface 306, preferably with a wood grain pattern 308; and a thickness 305 defining a casing body first side surface 310 and a casing body second side surface 312 at the top 304*a* of the U-shaped profile 304 and extending along the casing body length 303. It should be noted that any reference to direction or orientation should not be construed as limiting.

A preferred casing body length 303 may be provided as a predetermined length or it may be customized to the dimensions of a door or window 34 (see FIG. 22) to be cased on a building structure. A preferred casing body thickness 305 is preferably an average of about ⅜ inch; however, other thicknesses are contemplated.

The casing member 300 preferably comprises a plurality of attachment straps 370 extending outward from the casing body first side surface 310 and/or the casing body second side surface 312. Each of the attachment straps 370 preferably has a plurality of holes 372 along its length. Each strap 370 may extend through the profile 304, being immersed and held within the thickness 305, protruding from both the first side surface 310 and the second side surface 312. Additionally or alternatively, each strap 370 may extend from only one of the first side surface 310 and the second side surface 312.

The casing member 300 may comprise a predetermined sill angle $\alpha$, provided on one or both longitudinal sides of the casing member 300, for water run-off purposes. In such arrangement the second stem 304*c* has an outer surface that is angled away from the first stem 304*b* at the sill angle $\alpha$. Preferably, the sill angle $\alpha$ will be approximately 15 degrees, however, other sill angles $\alpha$ of various degrees are contemplated.

The casing member 300 may comprise a pair of casing member end caps 313, one at each end 302*a* of the casing body 302. Alternatively, no end caps 313, or only a single end cap 313, may be used in particular situations. Preferably, the casing member end caps 313 have a thickness 305 and completely cover the U-shaped profile 304 at each end 302*a* of the casing body 302, or the caps 313 are nested within the U-shaped profile 304, which may be advantageous if the caps 313 are provided as a different material and adhered or affixed to the member 300.

Figure 24:
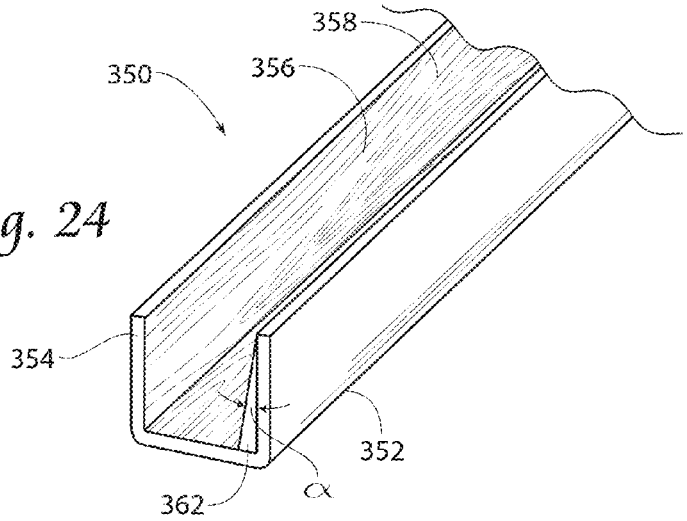
FIG. 24 is a perspective view of a third embodiment of a form according to the present invention.
Figure 25:
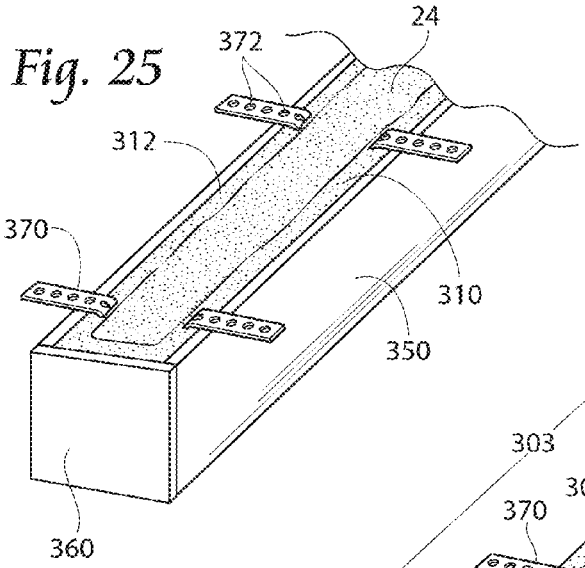
FIG. 25 is a perspective view of the embodiment of FIG. 21 curing in the form of FIG. 24 according to the present invention.
Figure 26:
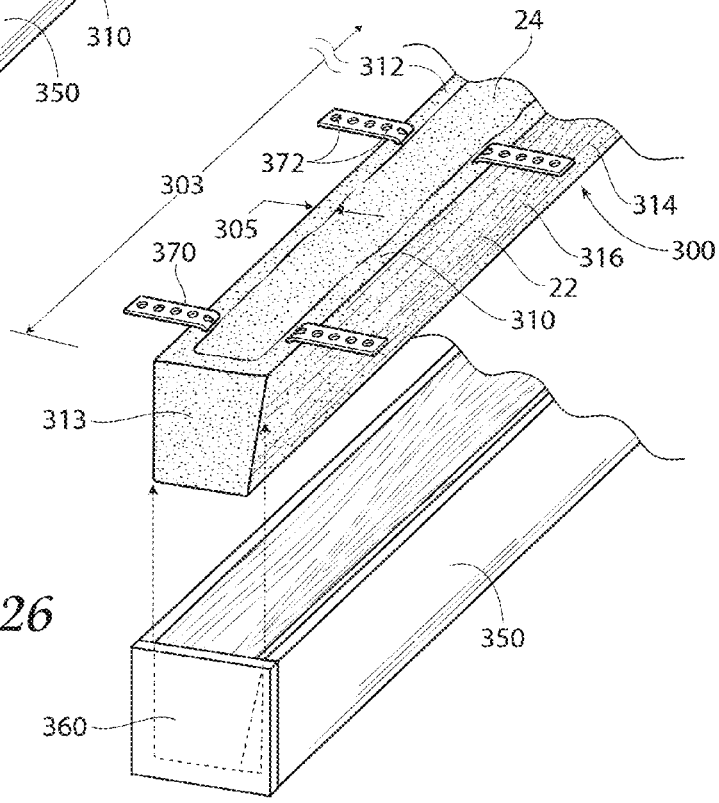
FIG. 26 is a perspective view of the embodiment of FIG. 21 being removed from the form of FIG. 24 according to the present invention.

The casing member 300 may be produced using a casing member form 350 as shown in FIGS. 24-26. The casing member form 350 preferably comprises a substantially square cross-section PVC schedule 40 pipe 352 with one side having been removed (not shown). It is contemplated that the square pipe 352 may be comprised of other pipes exhibiting similar characteristics to that of PVC and that the dimensions may vary if various sized casing members 300 are desired. A wood grain pattern 356 is preferably engraved on the casing member form interior surface 354 with an engraving tool 12. The form 350 may include a casing member form seal plate 360 secured to each end 352*a* of the square pipe 352. The casing member form seal plate 360 preferably has a shape that will cover each end 352*a*.

As discussed above, it may be preferred to angle at least one of the first and second stems 304*b,c* of the U-shape profile 304 at the sill angle α. This may be accomplished by installing a sill insert, such as a longitudinal wedge member 362, into the casing member form 350 prior to forming or molding the casing member 300. Preferably the sill insert 362 will replicate the sill angle α of 15 degrees. Alternatively, a longitudinal side of the pipe 352 may be formed at a preferred angle, such as by being heated and bent to such angle, or by being braced at such angle.

As shown in FIGS. 24-26, the production of the casing member 300 may be substantially similar to that of the lateral member 100. First, a release agent 20 (shown in FIG. 6) may be applied to the casing member form interior surface 354. Then, a first concrete layer 22 (preferably without glass fibers) (shown in FIG. 7) is brushed into the casing member form 350. Consecutive layers of a GFRC mixture 24 are sprayed into the casing member form 250, including onto the inside of the casing member form seal plates 260 (if included), and trowelled until the predetermined average thickness 305 is achieved. A plurality of attachment straps 370 are installed and trowelled into the casing body 302 so that they extend from the casing body first side surface 310 and/or the casing body second side surface 312. The casted casing body 302 may then be allowed to cure as shown in FIG. 25. After curing, the casing member 300 may be removed from the casing member form 350 as shown in FIG. 26.

Figure 27:
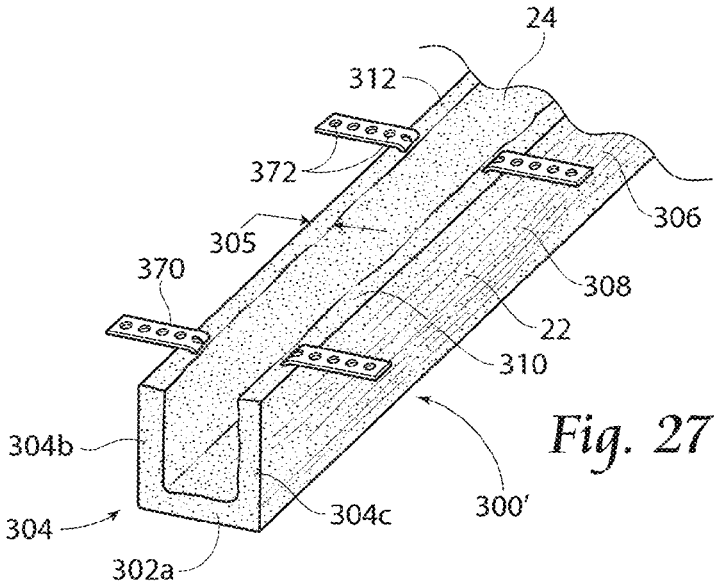
FIG. 27 is a perspective view of an alternative third embodiment of a concrete log member according to the present invention.

It is further contemplated that the casing member 300 may be formed without the casing member end caps 313. FIG. 27 illustrates an alternative casing member 300' without the casing member end caps 313 and with a U-shape profile 304 having parallel first and second stems 304*b,c*. Alternatively, end caps 313 could be provided in conjunction with parallel first and second stems 304*b,c*.

Figure 28:
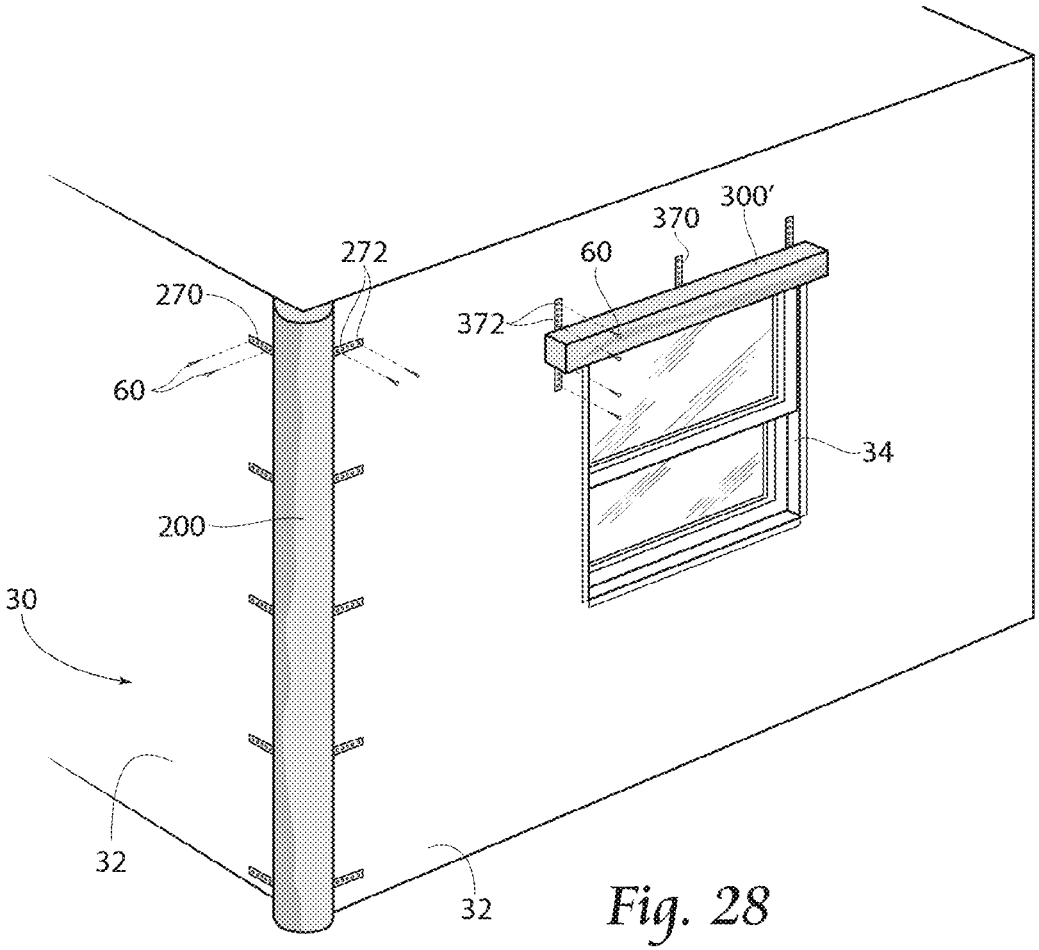
FIG. 28 is a perspective view depicting an installation of concrete log members according to the present invention on a building structure.

Looking to FIG. 28, installation of the corner member 200 to a structure 30 may involve mating the pair of corner member end caps 213 with a corner formed by two adjacent exterior walls 32, placing the straps 270 against the walls 32 and securing the straps 270 to the walls 32 with fasteners 60, thereby retaining the corner member 200 against the wall corner. Fasteners 60 may be any type known to one in the art, including but not limited to screws, nails, staples, and anchors.

Similarly, installation of a casing member 300 may involve placing the casing body first side surface 310 and casing body second side surface 312 against the exterior of the wall 32 next to a door or window 34, placing the straps 370 against the wall 32 and securing the straps to the walls 32 with fasteners 60, thereby retaining the casing member 300 to the wall 32.

Figure 29:
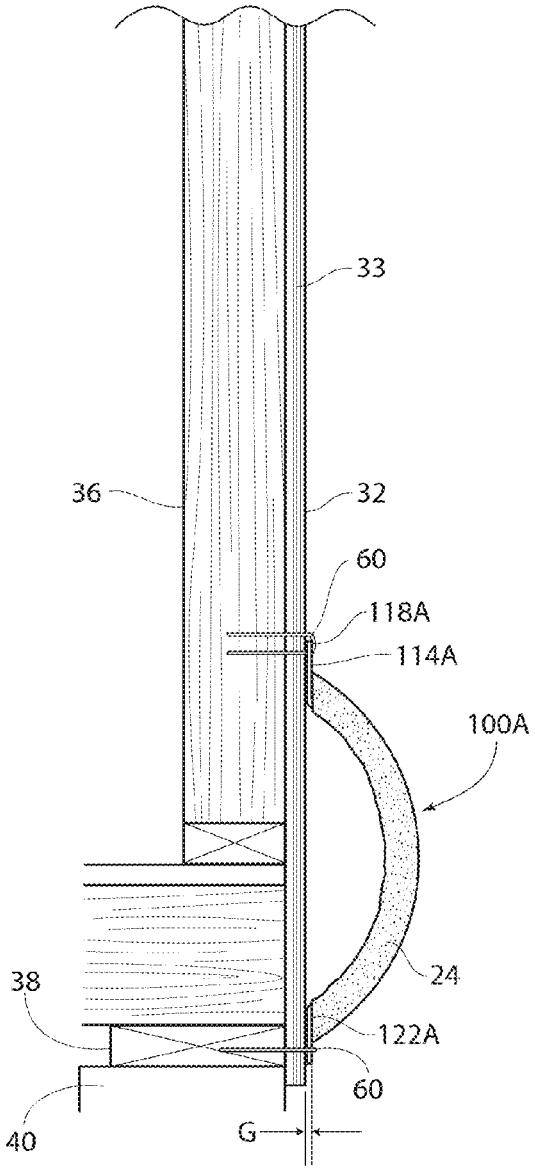
FIGS. 29-32 are side views of concrete log installation steps according to the present invention.

Now turning to FIGS. 29-32 installation of a lateral member 100 to be supported by an exterior wall 32 of a structure 30 is shown. FIG. 29 illustrates a first lateral member 100A (as part of a first course) placed against the wall 32 with the nailing anchor 114A on the top and the pinning anchors 122A on the bottom. An end 102*a* of the member 100 may be abutted to a corner member 200, which may have been previously installed on the structure 30. As shown here, a plurality of fasteners 60 are installed which capture the exposed rail 118A of the nailing anchor 114A, into the wall 32, and preferably continue further to engage a wall stud 36. Additionally, the pinning anchors 122A may be secured to the wall by the fasteners 60, and preferably the first course pinning anchors 122A are also secured to a building structural component, such as a sill plate 38 (as shown here), a wall stud 36, or foundation 40, or to a wall sheeting member 33, such as plywood.

Figure 30:
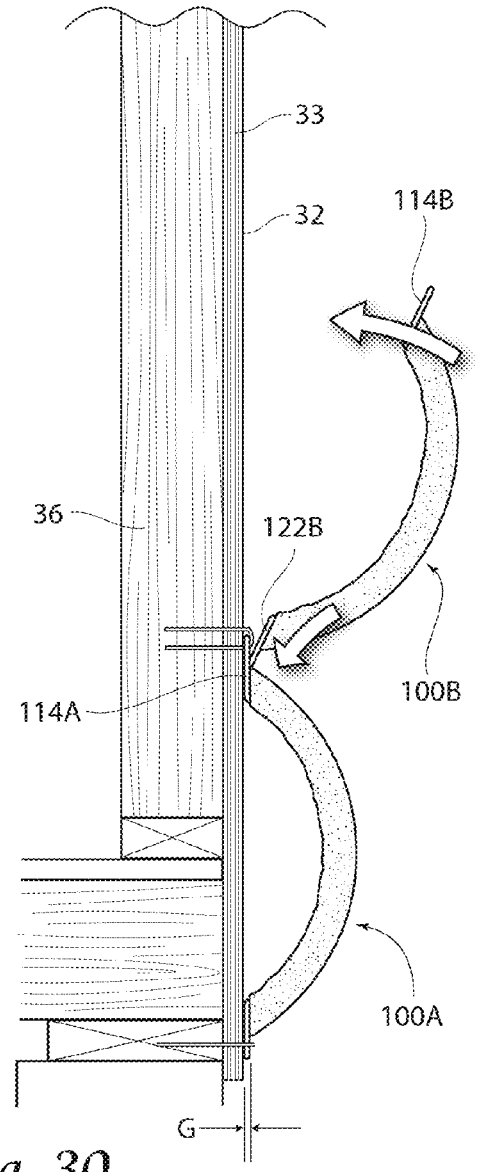
Figure 31:
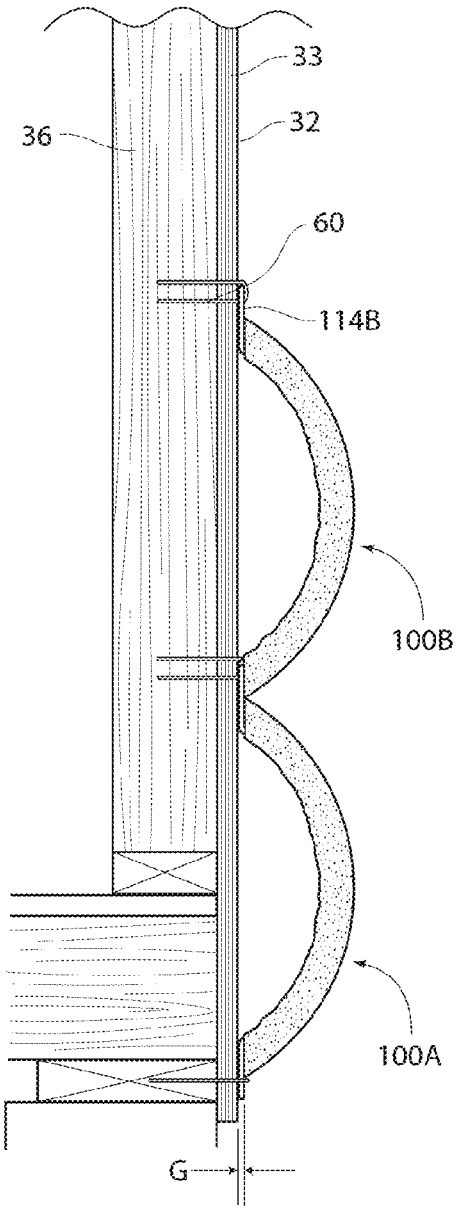

FIG. 30 illustrates an installation of a second course comprising a second lateral member 100B. Here, the pinning anchors 122B of the second lateral member 100B are placed behind the first lateral member 100A and below the exposed rail 118A of the nailing anchor 114A of the first lateral member 100A. As shown in FIG. 31, the interlocking of the first lateral member 100A and the second lateral member 100B promotes a flush fit against the wall 32. Additionally, the orientation of the nailing anchor 114 and the pinning anchors 122 space the lateral members 100 slightly away from the wall 32, thereby providing an air gap G to promote ventilation and evaporation of any moisture which may build up behind the lateral members 100. Similar to the nailing anchor 114A of the first lateral member 100A, the nailing anchor 114B of the second lateral member 100B is secured to the wall with fasteners 60.

Figure 32:
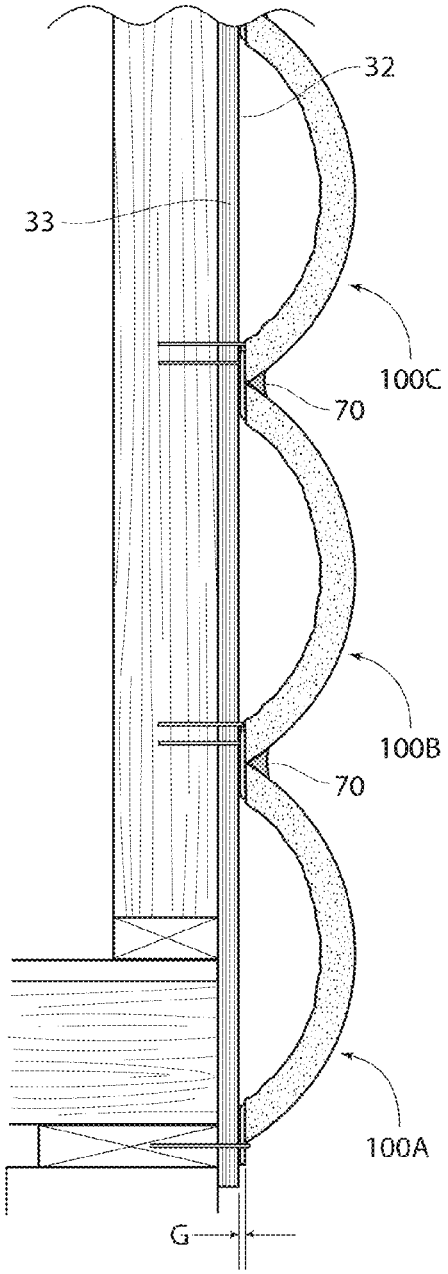

FIG. 32 further illustrates a third lateral member 100C installed above the second lateral member 100B in the same manner as previously described. Additionally, chinking and/or caulk 70 is installed between consecutive courses of lateral members (100A, 100B, 100C, etc.) to seal the joints and to prevent contaminants from reaching the wall 32. If a wall 32 is longer than a provided lateral member 100, the members 100 may be abutted end-to-end to span the entire wall length. In this situation, the abutments are also preferably sealed with chinking and/or caulk.

Figure 33:
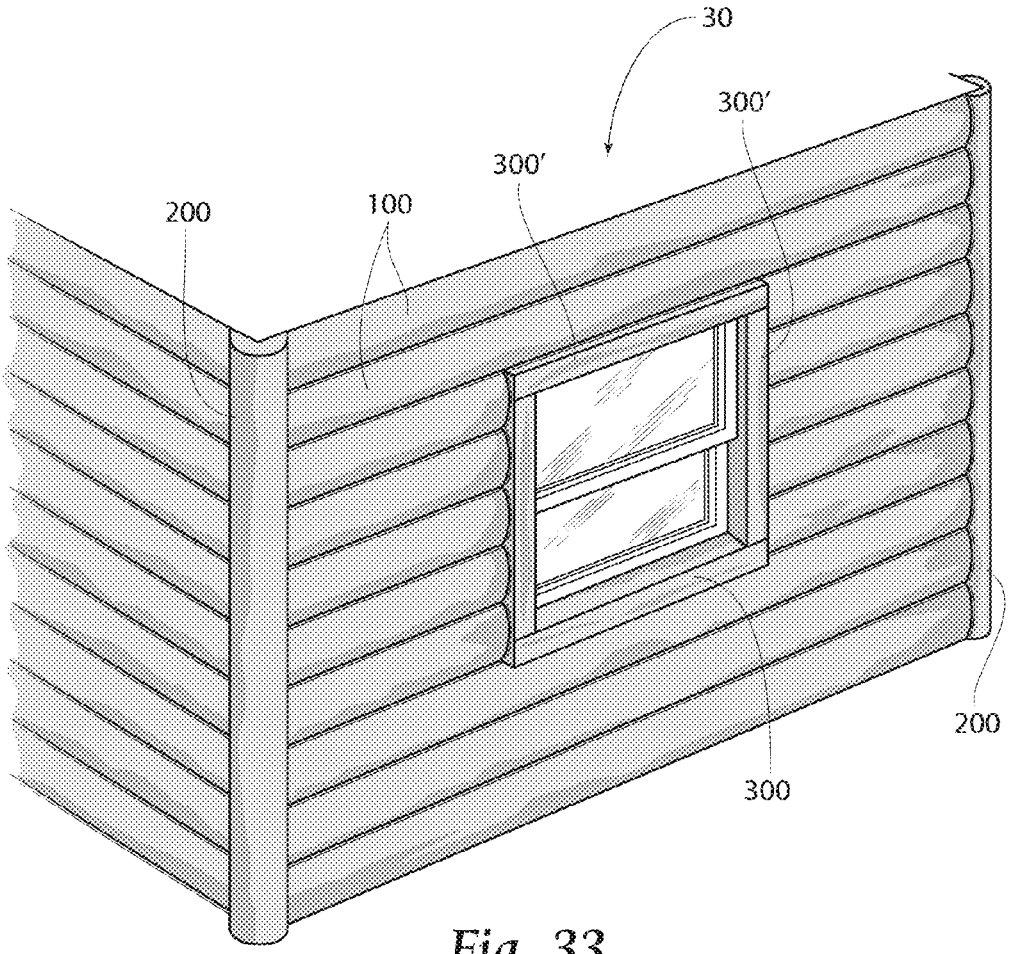
FIG. 33 is a perspective view of the structure with the concrete log members installed.

FIG. 33 illustrates the structure 30 with lateral members 100, corner members 200, and casing members 300 constructed and installed by the methods discussed herein.

A preferred GFRC mixture 24 that may be used to form any of the siding member embodiments described herein preferably comprises one or more types of glass fiber, cement, sand, water, polymer, plasticizer, and optional, but preferred, coloring. The glass fiber may be alkali resistant glass (ARG) of a preferred length, such as about 10 to about 50 millimeters in length, with a preferred length of nominally 19 millimeters and 38 millimeters provided at a ratio of 3:2. Such material is available from Nippon Electric Glass America, Inc. The cement is preferably Portland cement, and the sand is preferably a silica sand having a maximum size of about 0.6 mm (#30 sieve). The plasticizer used in the mixture is preferably an admixture, such as the water reducing admixture, ADVA190, available from Grace Concrete Products. More specifically, a preferred GFRC mixture 24 includes, in percent by weight, about 1% to about 2% (e.g., 1.4%) 19PH901X glass fiber, about 0.5% to about 2% (e.g., 0.9%) 38H530X glass fiber, about 40% to about 50% (e.g., 44.1%) Portland cement type I/II, about 35% to about 40% (e.g., 37.6%) #30 sand, about 5% to about 12% (e.g., 10.8%) water, about 2% to about 5% (e.g., 3.8%) liquid polymer (acrylic), up to about 2% (e.g., 1.4%) coloring, and a predetermined amount of a plasticizer, such as about 0.5 fluid ounces of ADVA 190 (super plasticizer).

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A simulated log siding system comprising:

at least one lateral member comprising: a lateral body comprising a concrete mixture and having a lateral body length, a lateral body arc profile perpendicular to the lateral body length, and a lateral body outer surface, the lateral body arc profile having a thickness defining a lateral body first side surface and a lateral body second side surface at the base of the lateral body arc and along the lateral body length; the lateral body outer surface comprising a wood grain pattern; a nailing anchor extending outward from the lateral body against the lateral body first side surface perpendicular to, and along, the lateral body length; and a plurality of pinning anchors extending outward from the lateral body against the lateral body second side surface perpendicular to, and spaced along, the lateral body length;

at least one corner member comprising: a corner body comprising a corner body length, a corner body arc profile perpendicular to the corner body length, and a corner body outer surface, the corner body arc profile has a thickness defining a corner body first side surface and a corner body second side surface extending along the corner body length; the corner body surface comprising a wood grain pattern; a pair of corner member end-caps, one at each end of the corner body length and shaped to receive the corner of a structure; and a plurality of straps extending outward from, and spaced along, the corner body first side surface and the corner body second side surface, each of the plurality of straps has a plurality of holes;

at least one casing member comprising: a casing body having a casing body length, a substantially square U-shape profile perpendicular to the casing body length, a casing body exterior surface, and a thickness defining a casing body first side surface and a casing body second side surface at the top of the U-shape and extending along the casing body length; the casing body exterior surface comprising a wood grain pattern; a plurality of straps extending outward from, and spaced along, the casing body first side surface and the casing body second side surface, each of the plurality of straps has a plurality of holes; and a plurality of fasteners for attaching the at least one lateral member, the at least one corner member, and the at least one casing member to the exterior of a structure.

2. The simulated log siding system of claim 1, wherein the corner member arc profile emulates a half circle.

3. The simulated log siding system of claim 1, wherein the casing body further comprises a pair of casing member end caps on each end of the casing body length.

4. The simulated log siding system of claim 1, wherein the casing body comprises one stem of the square U-shape profile angled away from parallel with the opposing stem.

5. The casing body of claim 4, wherein the angle is approximately 15°.

6. A method for installing a simulated log siding system to the exterior walls of a structure, the method comprising the steps of:

providing at least one lateral member comprising: a lateral body comprising a concrete mixture and having a lateral body length, a lateral body arc profile perpendicular to the lateral body length, and a lateral body outer surface, the lateral body arc profile has a thickness defining a lateral body first side surface and a lateral body second side surface at the base of the lateral body arc and along the lateral body length; the lateral body outer surface comprising a wood grain pattern; a nailing anchor extending outward from the lateral body against the lateral body first side surface perpendicular to, and along, the lateral body length; and a plurality of pinning anchors extending outward from the lateral body against the lateral body second side surface perpendicular to, and spaced along, the lateral body length;

providing at least one corner member comprising: a corner body comprising a corner body length, a corner body arc profile perpendicular to the corner body length, and a corner body outer surface, the corner body arc profile has a thickness defining a corner body first side surface and a corner body second side surface extending along the length of the corner body; the corner body surface comprising a wood grain pattern; a pair of corner member end-caps, one at each end of the corner body length and shaped to receive the corner of a structure; and a plurality of straps extending outward from, and spaced along, the corner body first side surface and the corner body second side surface, each of the plurality of straps has a plurality of holes;

providing at least one casing member comprising: a casing body having a casing body length, a substantially square U-shape profile perpendicular to the casing body length, a casing body exterior surface, and a thickness defining a casing body first side surface and a casing body second side surface at the top of the U-shape and extending along the casing body length; the casing body exterior surface comprising a wood grain pattern; a plurality of straps extending outward from, and spaced along, the casing body first side surface and the casing body second side surface, each of the plurality of straps has a plurality of holes;

providing a plurality of fasteners;

installing the at least one corner member to a corner of the structure by mating the pair of corner member end-caps with two adjacent exterior walls of the structure and securing the at least one corner member by installing the fasteners through at least one of the plurality of holes of each of the plurality of straps and into the respective exterior wall;

installing the at least one casing member to at least one side of a window frame and door frame and securing the at least one casing member by installing the fasteners through at least one of the plurality of holes of each of the plurality of straps and into the side of the window frame or door frame;

installing a first course of at least one lateral member to the exterior wall of the structure by placing the at least one member against the exterior wall with the nailing anchor oriented up and installing one of the fasteners about the rail of the nailing anchor and into the exterior wall;

installing a second course of at least one lateral member to the exterior wall of the structure by placing the at least one pinning anchor of the second course lateral member behind the first course lateral member and behind the first course lateral member nailing anchor, and installing one of the fasteners about the rail of the nailing anchor of the second course lateral member and into the exterior of the wall; and installing consecutive courses of lateral members until the exterior wall is substantially covered.

* * * * *